US005339008A

United States Patent [19]

Lapatovich et al.

[11] Patent Number: 5,339,008

[45] Date of Patent: Aug. 16, 1994

[54] ELECTROMAGNETIC DISCHARGE APPARTUS WITH DUAL POWER AMPLIFIERS

[75] Inventors: Walter P. Lapatovich, Marlborough; Scott J. Butler, North Oxford; Robert K. Smith, Wilmington, all of Mass.

[73] Assignee: Osram Sylvania Inc., Danvers, Mass.

[21] Appl. No.: 46,694

[22] Filed: Apr. 13, 1993

[51] Int. Cl.[5] ..... H05B 41/26

[52] U.S. Cl. ..... 315/248; 315/39

[58] Field of Search ..... 315/39, 248

[56] References Cited

U.S. PATENT DOCUMENTS

| | | | |
|---|---|---|---|
| 4,041,352 | 8/1977 | McNeill et al. | 315/248 |
| 4,266,162 | 5/1981 | McNeill et al. | 315/39 |
| 5,040,184 | 8/1991 | Murray | 315/248 X |
| 5,070,277 | 12/1991 | Lapatovich | 315/248 |
| 5,130,612 | 7/1992 | Lapatovich et al. | 315/248 |
| 5,144,206 | 9/1992 | Butler et al. | 315/39 X |
| 5,146,137 | 9/1992 | Gesche et al. | 315/39 X |

OTHER PUBLICATIONS

Microstrip Lines and Slotlines, Gupta, K. C., Ramesh, G. and Bahl, I. J., Artech House, Dedham, Mass. (1979) pp. 251–252.

*Primary Examiner*—David Mis

*Attorney, Agent, or Firm*—Carlo S. Bessone

[57] ABSTRACT

An electromagnetic discharge apparatus including a solid state supply or lamp ballast for energizing an electrodeless high intensity discharge (HID) lamp in a dual-ended fashion. A low power signal from a high frequency oscillator is split into two separate signals with definite phase relationship which are coupled to separate power amplifiers. In one embodiment, the signal from the high frequency oscillator is mixed with a signal from a modulation oscillator to AM, FM or pulse-width (PWM) modulate the power delivered to the lamp. This technique permits better control over the balance of power delivered to the ends of the lamp.

14 Claims, 7 Drawing Sheets

ELECTROMAGNETIC DISCHARGE APPARTUS WITH DUAL POWER AMPLIFIERS

FIELD OF THE INVENTION

This invention relates in general to electric discharge devices and pertains, more particularly, to an electromagnetic discharge apparatus for electrodeless high intensity discharges, commonly referred to as electrodeless HID arc lamps.

BACKGROUND OF THE INVENTION

Electrodeless light sources which operate by coupling high frequency power to a high pressure arc discharge in an electrodeless lamp have been developed. These light sources typically include a high frequency power source connected to a termination fixture with an inner conductor and an outer conductor surrounding the inner conductor. The electrodeless lamp is positioned at the end of the inner conductor and acts as a termination load for the fixture. The termination fixture has the function of matching the impedance of the electrodeless lamp during high pressure discharge to the output impedance of the high frequency power source. Thus, when the high pressure discharge reaches steady state, a high percentage of input high frequency power is absorbed by the discharge in the electrodeless lamp.

Previous patents describe electrodeless light sources wherein the termination fixture couples power to one end of the electrodeless lamp. While light sources with single-ended coupling give generally satisfactory results, they have certain disadvantages. In the situation where power is coupled to one end of the lamp and the other end is open-circuited, the electric field in the lamp decreases with increasing distance from the power coupling conductor. As a result, arc intensity also decreases with increasing distance from the power coupling conductor. This gives rise to a non-uniform luminance.

Non-uniform arcs are undesirable for several reasons. They produce both hotspots and coldspots in the wall of the envelope. Hotspots occur adjacent to points of maximum arc intensity and at points where the arc attaches to the lamp envelope. The envelope wall material has a maximum operating temperature. Therefore, the total power which can be delivered to the lamp without exceeding the maximum temperature is reduced by the existence of hotspots. The light output of the lamp is correspondingly lowered. Moreover, for a given value of input power, the life of the lamp is reduced when hotspots occur. Coldspots occur at the points on the lamp wall which are most distant from the arc and are undesirable because fill material can condense on the lamp envelope at coldspots and can block a portion of the light output by absorption. Conversely, a more uniform arc results in a more uniform wall temperature and a higher level of input power and light output can be achieved. Also, the life of the lamp is increased when temperature variations over the wall of the lamp is minimized. Therefore, in powering electrodeless HID lamps, it is advantageous to deliver power at both ends of the tubular capsule to permit even heating of the lamp envelope.

U.S. Pat. No. 4,266,162, which issued to McNeill et al on May 5, 1981, describes an electromagnetic discharge apparatus having a coupling fixture which couples power to both ends of an electrodeless discharge vessel. Power is coupled to the fixture from either two high frequency power sources or from a single high frequency power source by using a power divider. Since phasing and power dividing is performed in the high power sections of the apparatus, increased costs and power handling requirements of the electronics are required.

U.S. Pat. No. 5,070,277, which issued to Lapatovich on Dec. 3, 1991, describes a dual-ended excitation scheme to deliver microwave power to a cylindrical lamp capsule used in an electrodeless lamp. A single microwave power source delivers power at levels of about 25 W to an applicator where it is divided and applied to both lamp ends via a microstrip balun.

Although the above-described methods for delivering power to both ends of a lamp have been employed with varying degrees of success, it has been discovered that certain disadvantages still exist. For example, difficulties associated with power imbalance exist which produce overheating of one end of the lamp. Moreover, non-uniform temperature distribution along the lamp envelope is produced which leads to condensate redistribution in undesired fashion. This leads to reduced lamp light output and accelerated attack by chemical fill species. For these reasons, an improvement in the power distribution and subsequent heating of the lamp envelope would be significant.

SUMMARY OF THE INVENTION

It is, therefore, an object of the present invention to obviate the disadvantages of the prior art.

It is still another object of the invention to provide an improved electromagnetic discharge apparatus which delivers power to both ends of the lamp.

It is another object of the invention to provide an improved electromagnetic discharge apparatus wherein the costs and power handling requirements of the electronics are reduced and long-term reliability improved.

It is still another object of the invention to provide an improved electromagnetic discharge apparatus which results in improved power balance and a more uniform temperature distribution along the lamp envelope.

These objects are accomplished in one aspect of the invention by the provision of an electromagnetic discharge apparatus comprising an electrodeless discharge lamp including a discharge vessel having a first end and a second end and containing a fill material which supports electromagnetic discharge. The output of a first power amplifier is electromagnetically coupled to one end of the electrodeless discharge lamp and the output of a second power amplifier is electromagnetically coupled to the other end of the lamp. A first output of a power divider is coupled (e.g., via microstripline) to the input of the first power amplifier and a second output of the power divider is coupled (e.g., via microstripline) to the input of the second power amplifier. A high frequency oscillator for providing a low power signal has an output coupled to the input of the power divider.

In accordance with further aspects of the present invention, the electromagnetic discharge apparatus includes a mixer for modulating a carrier signal having an output coupled to the input of the power divider. A modulation oscillator for providing a modulation signal has an output coupled to a first input of the mixer. In the present embodiment, the output of the high frequency oscillator is coupled to a second input of the mixer.

In accordance with still further teachings of the present invention, the electromagnetic discharge apparatus includes a phase shifter having an input coupled to an output of the power divider and an output coupled to the input of the first power amplifier.

In accordance with further teachings of the present invention, the power divider produces low power signals at the first and second outputs 180° out of phase.

In accordance with further aspects of the present invention, the electromagnetic discharge apparatus includes a pair of AC input terminals and an AC-to-DC converter having an input coupled to the AC input terminals and having a DC output coupled to the high frequency oscillator and said first and second power amplifiers.

In accordance with still further aspects of the present invention, the electromagnetic discharge apparatus includes a pair of DC input terminals and a DC-to-DC converter having an input coupled to the DC input terminals and having a DC output coupled to the high frequency oscillator and the first and second power amplifiers.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
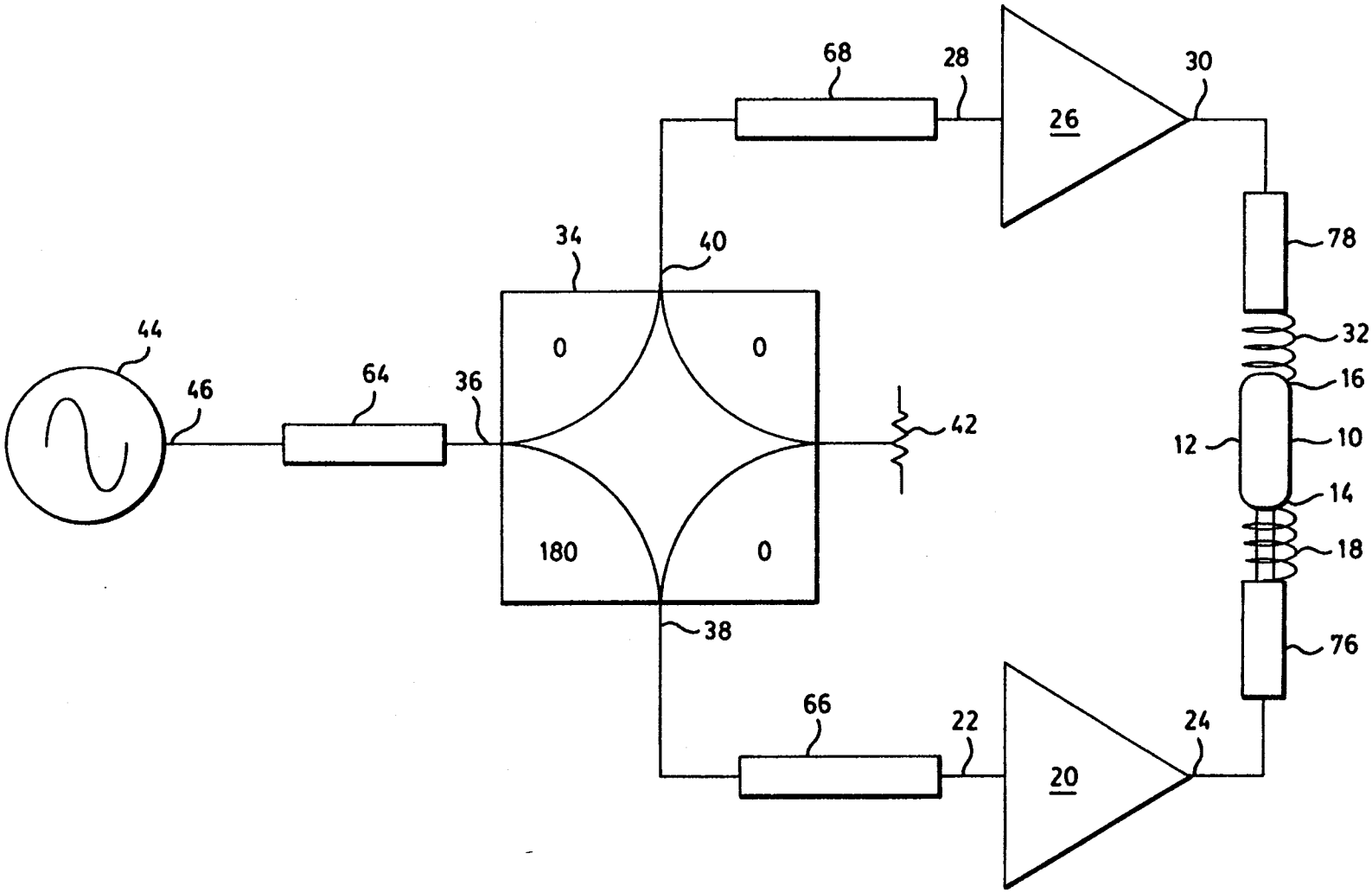
FIG. 1 represents a block diagram of one embodiment of an electromagnetic discharge apparatus according to the present invention.

Referring to the drawings, FIG. 1 illustrates a block diagram of an electromagnetic discharge apparatus according to one embodiment of the present invention. The apparatus includes an electrodeless discharge lamp 10 having a discharge vessel 12. Lamp envelope 12 has a first end 14 and a second end 16 and encloses a fill material which emits light during electromagnetic discharge. High frequency power is respectively coupled to ends 14 and 16 of electrodeless discharge lamp 10 by means of a pair of helical applicators 18 and 32 or their equivalent. An output 24 of a first power amplifier 20 is coupled to end 14 of electrodeless discharge lamp 10. Similarly, an output 30 of a second power amplifier 26 is coupled to end 16 of lamp 10. A first output 38 of a power divider 34 is coupled to an input 22 of first power amplifier 20. A second output 40 of power divider 34 is coupled to an input 28 of second power amplifier 26. A high frequency oscillator 44 for providing a low power signal has an output 46 coupled to an input 36 of power divider 34.

Oscillator 44 operates at a frequency in the range of from 100 MHz to 300 GHz and typically is in the ISM (Industrial, Scientific and Medical) band between 902 MHz and 928 MHz or the ISM band centered at 2.45 GHz. One preferred operating frequency is 915 MHz.

Preferably, electrodeless discharge lamp 10 consists of a capsule or vessel 12 capable of transmitting both radio frequency power and light. In the preferred embodiment, the capsule is made of a vitreous silica or similar light transmitting material defining an enclosed cylindrical volume having an internal length of less than 20.0 millimeters and an internal diameter of less than about 5.0 millimeters. The lamp capsule wall may be about 0.5 to 1.5 millimeters in thickness giving an outside diameter of about 2.0 millimeters to 8.0 millimeters depending on the capsule wall thickness. The preferred capsule has about a 10.0 millimeter internal length, a 2.0 millimeter internal diameter, and a 4.0 millimeter outer diameter.

The capsule encloses a lamp fill that may include various additional doping materials as is known in the art. The lamp fill composition is chosen to include at least one material that is vaporizable and excitable to emission by the radio frequency power. The preferred lamp fill comprises argon gas and a metallic compound, such as a metallic salt. Scandium iodide is a preferred metallic salt. One such lamp fill composition is 1.0 milligram of metallic mercury and 0.1 milligram of sodium-scandium iodide. The room temperature argon fill gas pressure is within the range of from about 5 to 50 tort, and preferably 20 torr. Further details on the construction of suitable lamp capsules are disclosed in U.S. Pat. No. 5,070,277 to Lapatovich.

Helical applicators 18 and 32 are intended to couple energy into lamp capsule 10 and are made of a metal such as nickel. In one example, the helical applicators were designed for operation at 915 MHZ using a capsule of internal diameter 2.0 millimeters and outside diameter of 4.0 millimeters. The helical applicators were fabricated from nickel wire 0.635 millimeter (0.025 inch) diameter and had an inside diameter of 5.0 millimeters, a pitch of 1.46 millimeters for 5.2 turns of coil, implying a total helical applicator length of 7.6 millimeters. The lamp capsule fitted in the final turn of the helical applicator without touching and was separated from the helical applicator by about 0.5 millimeter around the capsule's circumference.

Examples of electromagnetic coupling suitable for use in the present invention are the helical slow wave structures described in U.S. Pat. No. 5,070,277 to Lapatovich or the loop applicators described in U.S. Pat. No. 5,130,612 to Lapatovich et al. It is important to note that the EM coupling structures do not contact the lamp at any point.

As illustrated in FIG. 1, helical applicator 18 at lamp end 14 is coupled to output 24 of first power amplifier 20 by means of a 50 ohm microstrip transmission line 76. A 50 ohm microstrip 78 couples helical applicator 32 at lamp end 16 to output 30 of second power amplifier 26. Ordinarily, an impedance matching means is required between the power amplifier and the helical applicator, however, in the example cited, the discharge lamp and applicators provide an approximately matched impedance for the power amplifiers.

High frequency power delivered to lamp ends 14 and 16 by helical applicators 18 and 32 produces inside the lamp envelope a high frequency electric field which is sufficient to maintain discharge in the fill material. For reliable starting, the microwave induced electric field inside the lamp capsule should be greater than that needed to induce breakdown, which for standard electroded lamps with standard lamp fills is about 150 volts per centimeter. At high frequencies, this field is reduced. The requirements for field breakdown may be lowered substantially by applying a UV light source to the capsule during starting as disclosed, for example, in U.S. Pat. No. 4,041,352 issued to McNeill et al. High frequency power is converted to light and heat and, unlike single-ended coupling methods, produces a more uniform arc.

Input 22 of first power amplifier 20 is coupled by means of a 50 ohm microstrip 66 to a first output 38 of power divider 34. Another 50 ohm microstrip 68 couples input 28 of second power amplifier 26 to a second output 40 of power divider 34. Power divider 34 receives power at input 36 from the output 46 of high frequency oscillator 44 and divides the input power between first output 38 and second output 40. The input 36 of power divider 34 is coupled to output 46 of oscillator 44 by means of a 50 ohm microstrip 64. As illustrated in FIG. 1, power divider 34 includes an isolation resistor 42. Preferably, signals appearing at outputs 38 and 40 are 180° out of phase.

Instead of using planar transmission line technology for microstrips 64, 66, 68, 76, 78, it is possible to use other suitable coupling means such as coaxial leads.

Figure 2:
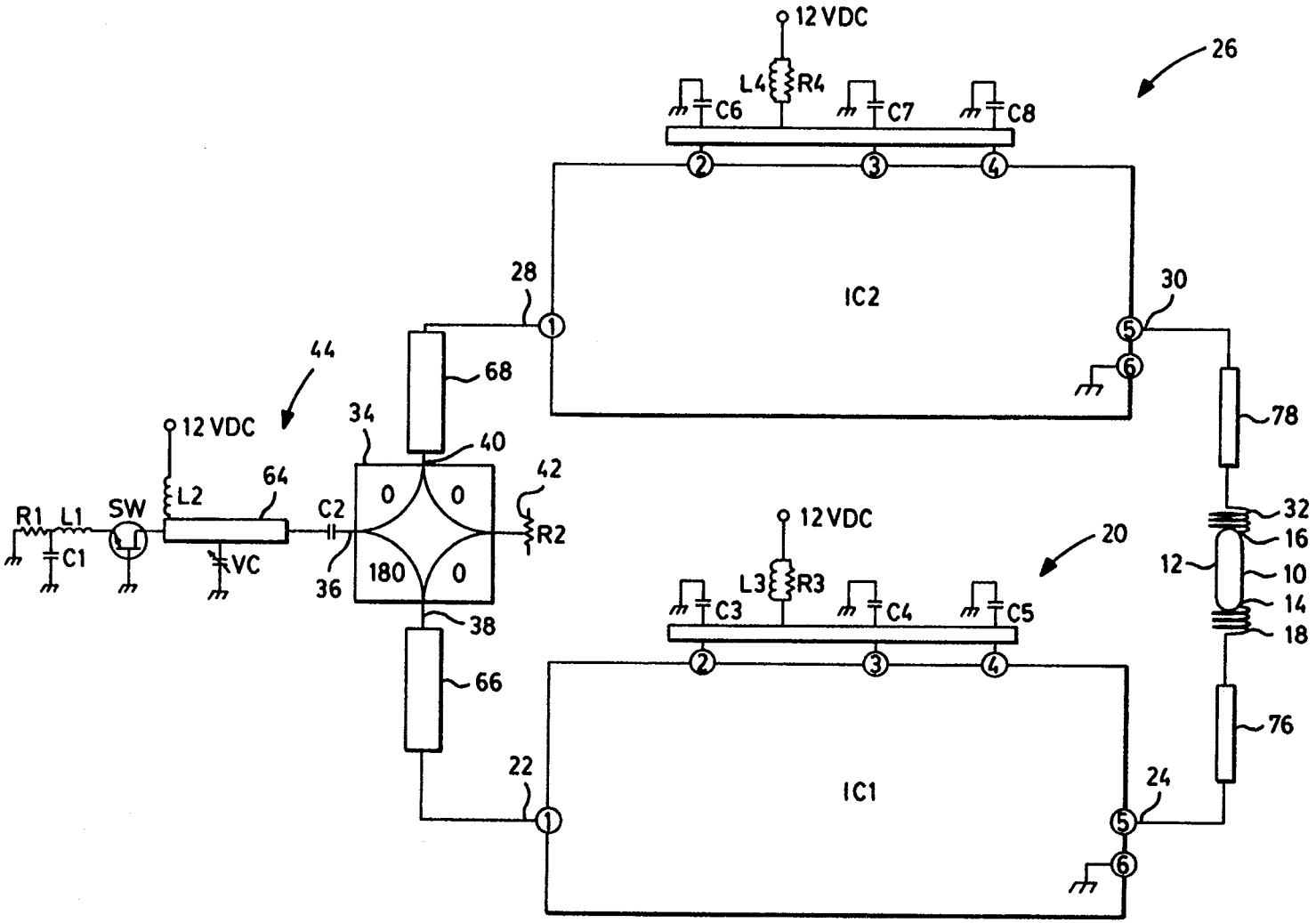
FIG. 2 is a schematic diagram of the embodiment of the electromagnetic discharge apparatus of FIG. 1.

FIG. 2 is a detailed schematic diagram of the embodiment of the electromagnetic discharge apparatus of FIG. 1. High frequency oscillator 44 includes a semiconductor active device SW such as a static induction transistor (SIT) having a source connected to one end of a choke L1. The other end of choke L1 is connected to a junction of a parallel combination of a capacitor C1 and a resistor R1. The drain of semiconductor switch SW is connected to one end of microstrip 64. A supply of DC power, such as 12 volts DC, is delivered to one end of microstrip 64 by means of a choke L2. A variable capacitor VC for adjusting the frequency of oscillator 44 is connected to a portion of microstrip 64. The low power signal (about 1 watt) produced by oscillator 44 is coupled through a capacitor C2 to the input 34 of power divider 36 where is divided between first output 38 and second output 40.

First power amplifier 20 includes an integrated circuit IC1 having an input 22 at pin 1. Pins 2, 3 and 4 of integrated circuit IC1 are bypassed to circuit ground by capacitors C3, C4 and C5, respectively. Pin 6 of integrated circuit IC1, which in this case is the metallic flange on the case, is connected to circuit ground. DC power is coupled to IC1 by means of a parallel combination of a coil L3 and a resistor R3. The output 24 of power amplifier 20 (at pin 5 of IC1) is connected to microstrip 76. In a similar manner, second power amplifier 26 includes an integrated circuit IC2 having an input 28 at pin 1. Pins 2, 3 and 4 of integrated circuit IC2 are bypassed to circuit ground by capacitors C6, C7 and C8, respectively. Pin 6 of integrated circuit IC2 is connected to circuit ground. DC power is coupled to IC2 by means of a parallel combination of a coil L4 and a resistor R4. The output 30 of power amplifier 26 (at pin 5 of IC2) is connected to microstrip 78.

Integrated circuits IC1 and IC2 of power amplifiers 20 and 26 can be commercially available packages manufactured for cellular telephone communications. One suitable type is Mitsubishi part M67720. It should be obvious to one skilled in the art that other amplifiers operating in the ISM bands could also be used.

As a specific example but in no way to be construed as a limitation, the following components are appropriate to an embodiment of the present disclosure, as illustrated by FIG. 2:

| Item | Description | Value of Part No. |
|---|---|---|
| R1 | Resistor | 56 ohm |
| R2 | Resistor | 50 ohm |
| R3, R4 | Resistors | 10 ohm, ¼ W |
| C1, C2 | Capacitors | 47 PFD |
| C3, C4, C5, C6, C7, C8 | Capacitors | 200 PFD |
| VC | Variable Capacitor | 3–10 PFD |
| L1, L2 | Inductors | 33 uH molded choke |
| L3 | Inductor | 7T, 20 AWG wound around R3 |
| L4 | Inductor | 7T, 20 AWG wound around R4 |
| SW | Transistor | 7 um pitch Single-Cell SIT |
| IC1, IC2 | Integrated Circuits | Mitsubishi M67720 |

The circuit of FIG. 2 can be fabricated from printed circuit board material using stripline or microstripline technology. Stripline or microstripline technology is lightweight, inexpensive, readily manufacturable, and compact when compared to waveguides at frequencies of 915 MHz or 2.45 GHz.

Figure 3:
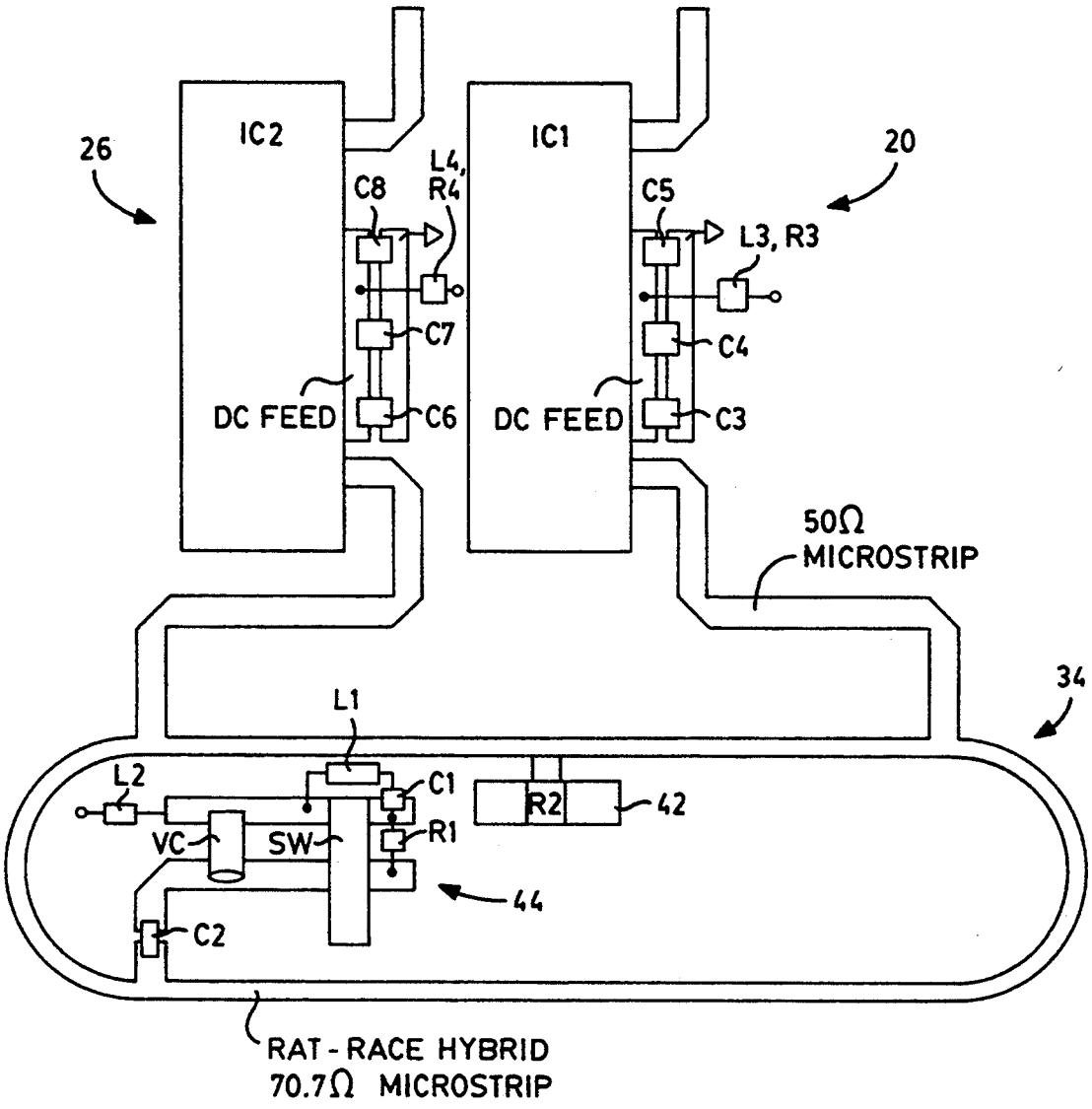
FIG. 3 is a preferred layout of the embodiment of the electromagnetic discharge apparatus of FIG. 1.

FIG. 3 is a preferred layout of the embodiment of the electromagnetic discharge apparatus of FIG. 2. In a preferred embodiment, the circuit is laid out using microstripline on teflon-fiberglass substrate with the oscillator contained within a hybrid printed power divider. The 180 degree power divider used in this embodiment is a rat race hybrid constructed from 70.7 ohm microstrip. The power divider includes an isolation resistor to damp any even mode excitation, i.e., absorbs any in-phase energy. The relevant design rules regarding a rat race hybrid are well known and discussed in, for example, Microstrip Lines and Slotlines, Gupta, K. C., Ramesh, G. and Bahl, I. J., Artech House, Dedham, Mass., (1979) pages 251–252. Other suitable materials may be used for fabrication of microstripline or stripline circuits such as alumina, quartz, aluminum nitride, air dielectric, or other ceramic or glass filled substrates.

The length and impedance of the lines are adjusted to accommodate the particular lamp being excited. In the embodiment described, the lamp and helices presented an impedance of $Z=R+jX$, with $R=96$ ohms and $X=38$ ohms. This results in an equivalent VSWR of 1.4:1 which approximates an impedance matched condition to the output of the power amplifiers when equal lengths of 50 ohm microstrip lines are used to connect the lamp and helices to the ballast. Such a device can deliver norminally 50 watts of microwave power at 915 MHz to a lamp. Measurements made at the outputs ports of the final amplifiers 20 and 26 terminated in 50 ohm loads, show 23.8 watts and 24.5 watts, respectively, with 180 degrees phase shift between signals. This corresponds to an amplitude imbalance of 0.126 dB.

Figure 4:
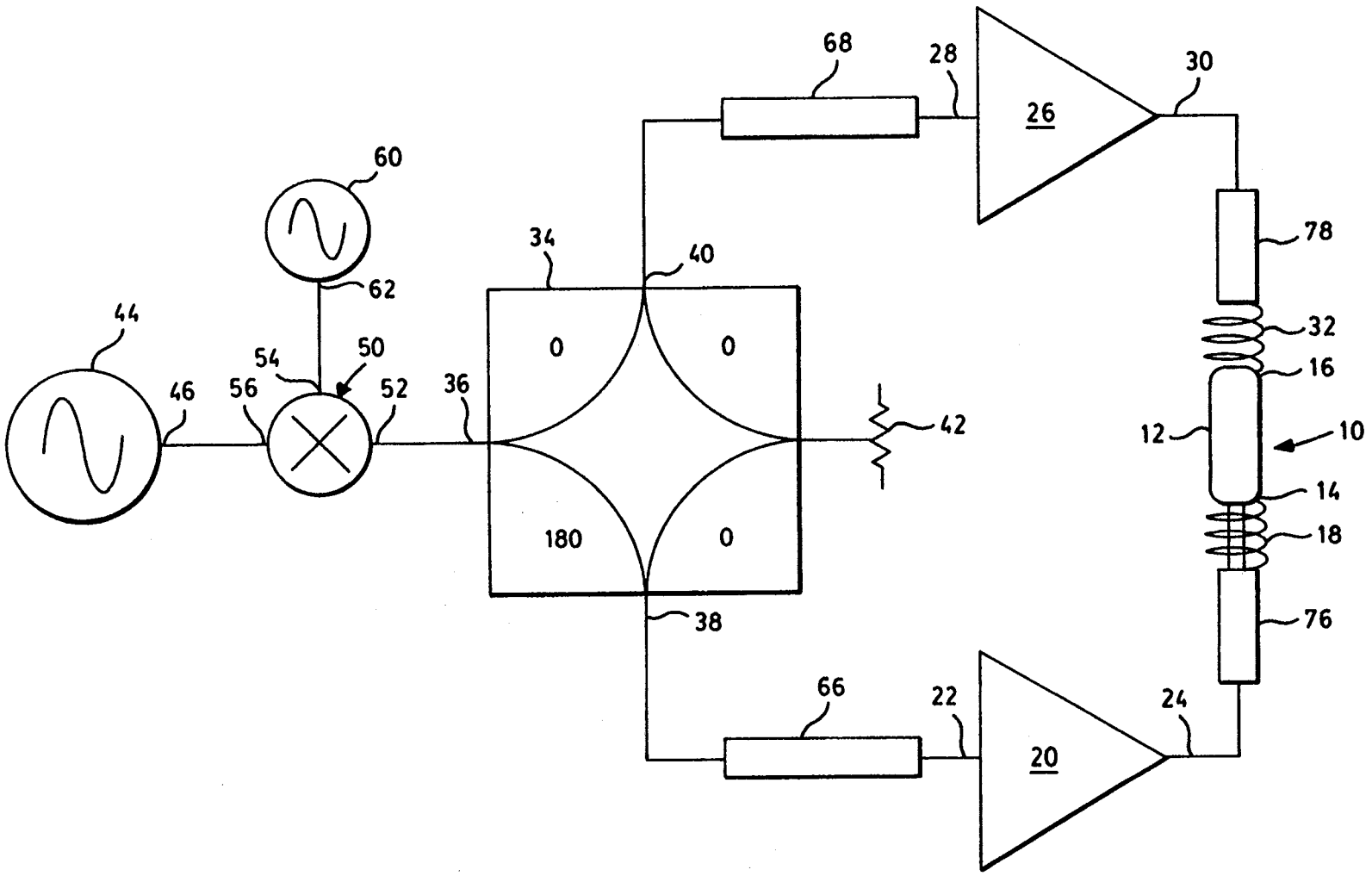
FIG. 4 is a block diagram of another embodiment of an electromagnetic discharge apparatus according to the present invention including a mixer and a modulation oscillator.

Referring next to FIG. 4, there is shown a block diagram of another embodiment of an electromagnetic discharge apparatus wherein substantially the same constituent members as those in FIG. 1 are denoted by the same reference numerals. As illustrated, FIG. 4 includes a mixer 50 for modulating a carrier signal from a high frequency oscillator 44. A modulation oscillator 60 for providing a modulation signal has an output 62 coupled to a first input 54 of mixer 50. High frequency oscillator 44 provides a low power carrier signal and has an output 46 coupled to a second input 56 of mixer 50. Mixer 50 has an output 52 coupled to input 36 of power divider 34. Importantly, the mixer and modulation oscillator, which provide amplitude modulation, are connected in the low power section of the apparatus. It should be obvious to one skilled in the art that a similar arrangement could be devised for frequency modulation (FM) or pulse-width modulation (PWM) of the low power oscillator signal.

Figure 5:
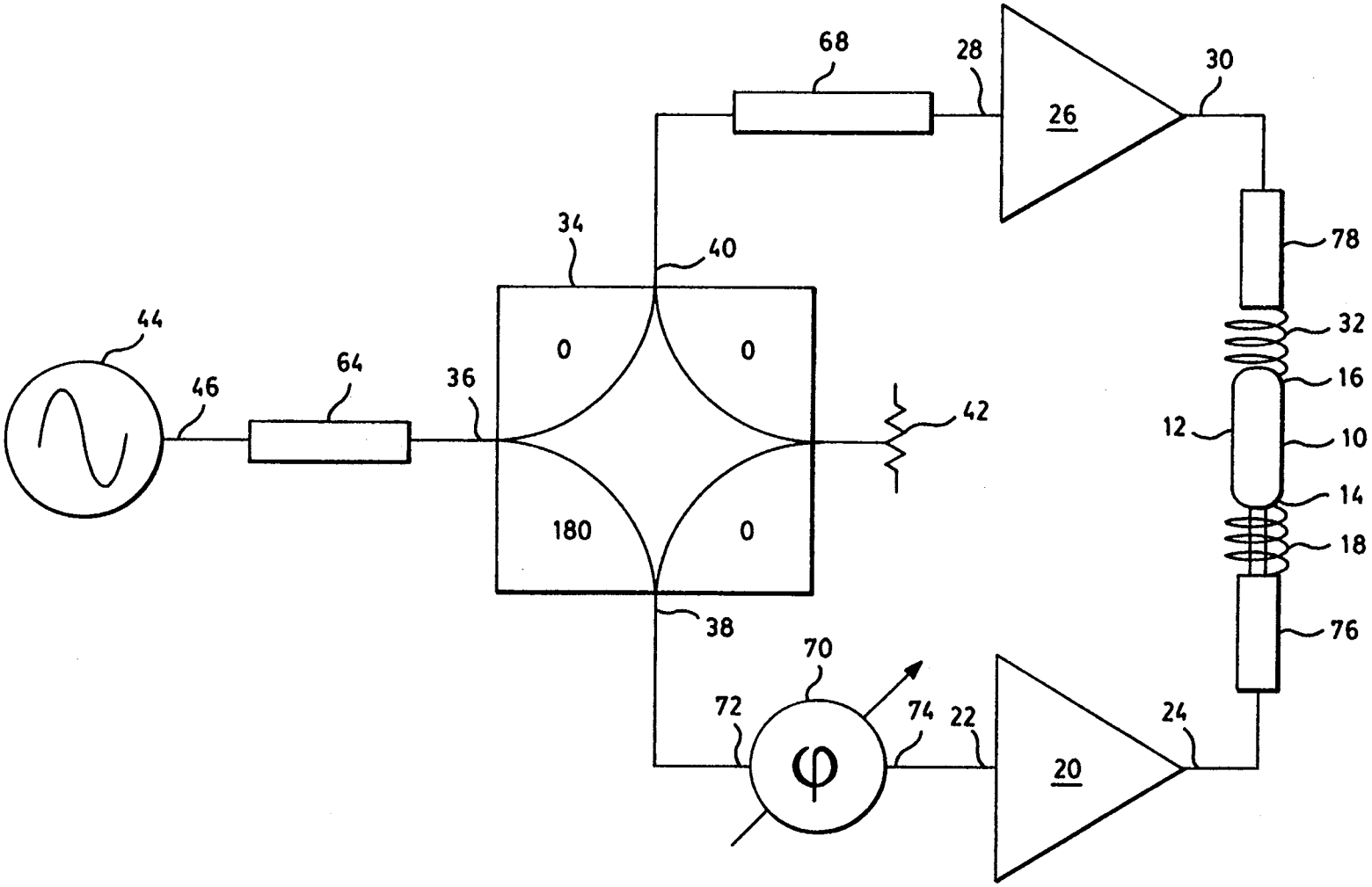
FIG. 5 is a block diagram of another embodiment of an electromagnetic discharge apparatus according to the present invention including a variable phase shifter.

FIG. 5 is a block diagram of another embodiment of an electromagnetic discharge apparatus according to the present invention including a phase shifter 70 located in the low power section for control of power delivery to the lamp. An output 74 of phase shifter 70 is coupled to input 22 of power amplifier 20. An input 72 of the phase shifter is coupled to output 38 of power divider 34. Preferably, the phase shifter is variable and may be manually or electrically controlled. Suitable devices for phase shifter 70 include adjustable delay lines and voltage controlled reactive elements (e.g., varactors or PIN diodes).

Figure 6:
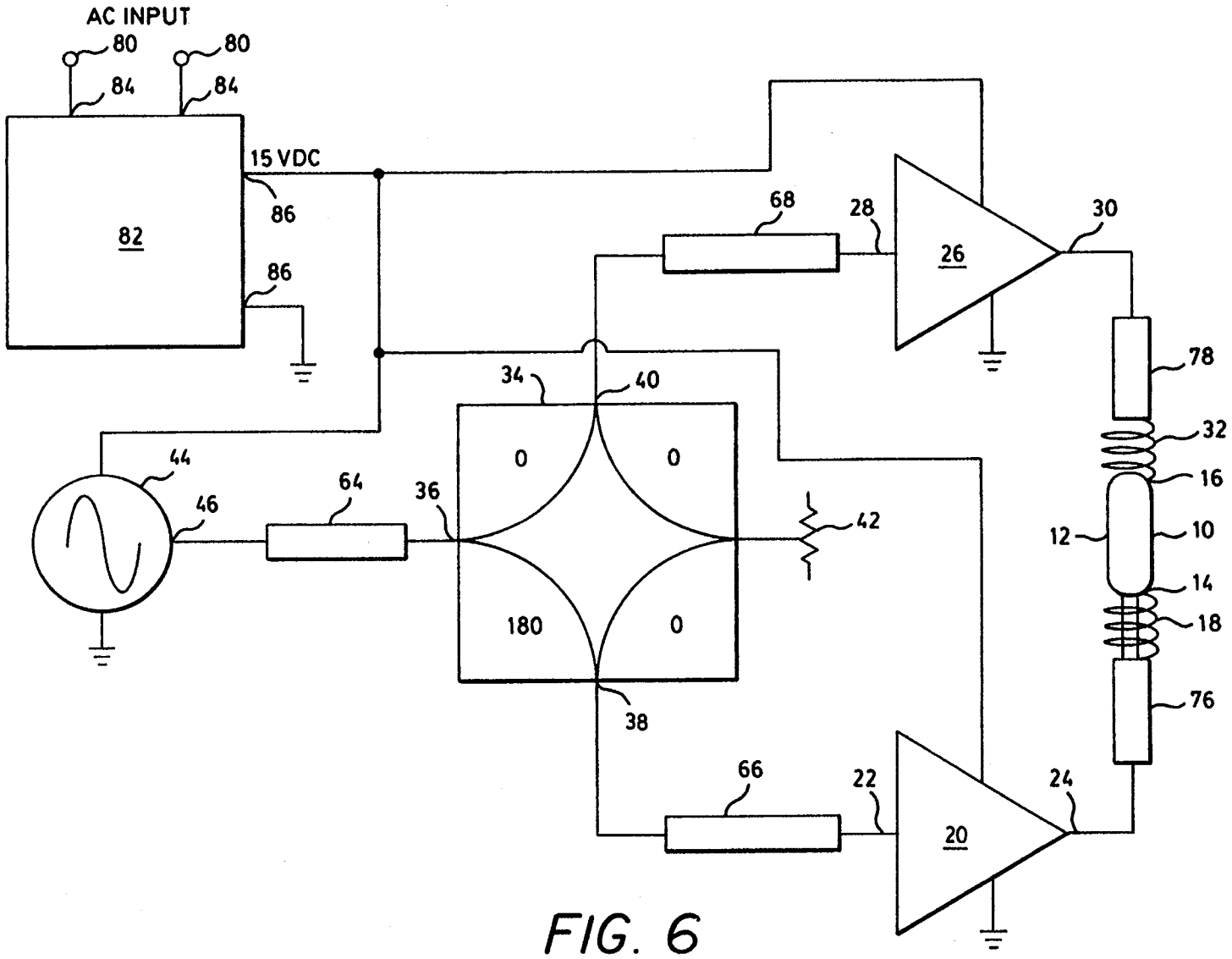
FIG. 6 is a block diagram of another embodiment of an electromagnetic discharge apparatus according to the present invention including an AC-to-DC converter.

The electromagnetic discharge apparatus described herein can be operated from line voltages or DC prime power with additional power conditioning electronics. FIG. 6 is a block diagram of another embodiment of an electromagnetic discharge apparatus which includes an AC-to-DC converter 82 for powering the ballast from line (AC) voltages. The input 84 of AC-to-DC converter 82 is coupled to a pair of AC input terminals 80. The output 86 of AC-to-DC converter 82 is coupled to high frequency oscillator 44 and first and second power amplifiers 20, 26.

Figure 7:
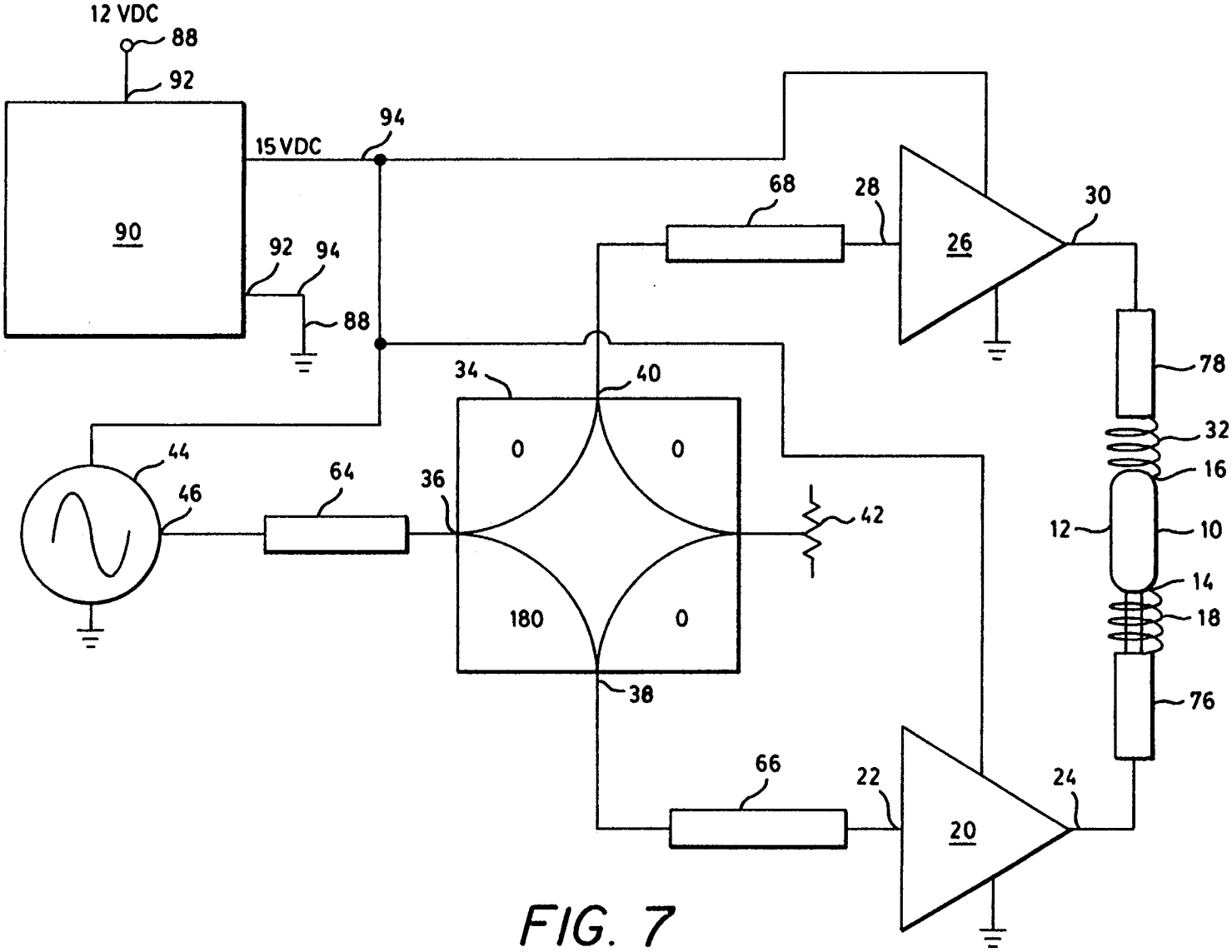
FIG. 7 is a block diagram of another embodiment of an electromagnetic discharge apparatus according to the present invention including a DC-to-DC converter.

FIG. 7 is a block diagram of another embodiment of an electromagnetic discharge apparatus according to the present invention including a DC-to-DC converter 90 to permit mobile installation such as in an automobile. DC-to-DC converter 90 has an input 92 coupled to a pair of DC input terminals 88. The DC output 94 of converter 90 is coupled to high frequency oscillator 44 and first and second power amplifiers 20, 26. It should be obvious to one skilled in the art that operation at frequencies other than 60 Hz can be achieved by proper conditioning of the prime power source, e.g., 50 Hz. in Europe and 400 Hz. for operation in aircraft.

There has thus been shown and described an electromagnetic discharge apparatus including a power supply/lamp ballast with low power oscillator, power division and phasing section, and a final amplifier or power section. The low power section can also contain a mixer so a modulated signal can be applied to the low power section. The modulation signal can be impressed on the carrier via amplitude, frequency, or pulse-width modulation (AM, FM, or PWM, respectively). According to the instant invention, the phasing and modulation are done in the low power section prior to final amplification to appropriate power levels. Control of the low power signal substantially reduces the cost and power handling requirements of the electronics.

The power supply/lamp ballast enables superior balance (i.e., power delivery) since series transmission line losses in a high power balun driving a lamp results is preferential current path leading to localized overheating. The instant invention removes the need for a high power balun.

Each end of the lamp can be independently impedance matched (this further improves balance). This is important since the geometry in lamp fabrication rarely permits two identical lamp ends, even in molded capsules. Consequently, some end-to-end impedance differences are anticipated for this reason alone.

The instant invention allows for a larger physical separation of the power devices in the ballast than can be achieved in a signal output design thereby improving the thermal characteristics. This is achieved without significantly increasing the overall size of the lighting system. Also, the instant invention allows for low power control of the differential phase shift, by inserting a variable phase shifter in one output of the power divider, which can be used to vary the power delivered to the lamp, since only the out-of-phase components of current are dissipated in the lamp. Since all phasing and tweaking can be done in the low power section of the circuit, line loss, heating and ratings on the power divider, phase shifter, mixer and oscillator are reduced. The life of the device will be extended accordingly.

The instant invention provides a simple way to increase the power to an electrodeless HID lamp going from a nominal 25 W in the prior art to a nominal 50 W in the present design. It should be obvious to one skilled in the art that the technique described herein can be applied to higher power levels.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. An electromagnetic discharge apparatus comprising:

electrodeless discharge lamp including a discharge vessel having a first end and a second end and containing a fill material which supports electromagnetic discharge;

first power amplifier having an input and having an output electromagnetically coupled to said first end of said electrodeless discharge lamp;

second power amplifier having an input and having an output electromagnetically coupled to said second end of said electrodeless discharge lamp;

power divider having an input and having a first output coupled to said input of said first power amplifier and a second output coupled to said input of said second power amplifier; and high frequency oscillator for providing a low power signal having an output coupled to said input of said power divider.

2. The electromagnetic discharge apparatus of claim 1 wherein said power divider produces low power signals at said first and second outputs 180° out of phase.

3. The electromagnetic discharge apparatus of claim 1 further including a pair of AC input terminals and an AC-to-DC converter having an input coupled to said AC input terminals and having a DC output coupled to said high frequency oscillator and said first and second power amplifiers.

4. The electromagnetic discharge apparatus of claim 1 further including a pair of DC input terminals and a DC-to-DC converter having an input coupled to said DC input terminals and having a DC output coupled to said high frequency oscillator and said first and second power amplifiers.

5. An electromagnetic discharge apparatus comprising:

electrodeless discharge lamp including a discharge vessel having a first end and a second end and containing a fill material which supports electromagnetic discharge;

first power amplifier having an input and having an output electromagnetically coupled to said first end of said electrodeless discharge lamp;

second power amplifier having an input and having an output electromagnetically coupled to said second end of said electrodeless discharge lamp;

power divider having an input and having a first output coupled to said input of said first power amplifier and a second output coupled to said input of said second power amplifier;

mixer for modulating a carrier signal having an output coupled to said input of said power divider and having a first input and a second input;

modulation oscillator for providing a modulation signal having an output coupled to said first input of said mixer; and high frequency oscillator for providing a low power carrier signal having an output coupled to said second input of said mixer.

6. The electromagnetic discharge apparatus of claim 5 wherein said power divider produces low power signals at said first and second outputs 180° out of phase.

7. The electromagnetic discharge apparatus of claim 5 wherein said mixer amplitude modulates, frequency modulates or pulse width modulates said low power carrier signal from said high frequency oscillator.

8. The electromagnetic discharge apparatus of claim 5 further including a pair of AC input terminals and an AC-to-DC converter having an input coupled to said AC input terminals and having a DC output coupled to said high frequency oscillator and said first and second power amplifiers.

9. The electromagnetic discharge apparatus of claim 5 further including a pair of DC input terminals and a DC-to-DC converter having an input coupled to said DC input terminals and having a DC output coupled to said high frequency oscillator and said first and second power amplifiers.

10. An electromagnetic discharge apparatus comprising:

electrodeless discharge lamp including a discharge vessel having a first end and a second end and containing a fill material which supports electromagnetic discharge;

first power amplifier having an input and having an output electromagnetically coupled to said first end of said electrodeless discharge lamp;

phase shifter having an input and having an output coupled to said input of said first power amplifier;

second power amplifier having an input and having an output electromagnetically coupled to said second end of said electrodeless discharge lamp;

power divider having an input and having a first output coupled to said input of said phase shifter and a second output coupled to said input of said second power amplifier; and high frequency oscillator for providing a low power signal having an output coupled to said input of said power divider.

11. The electromagnetic discharge apparatus of claim 10 wherein said phase shifter is variable.

12. The electromagnetic discharge apparatus of claim 10 wherein said power divider produces low power signals at said first and second outputs 180° out of phase.

13. The electromagnetic discharge apparatus of claim 10 further including a pair of AC input terminals and an AC-to-DC converter having an input coupled to said AC input terminals and having a DC output coupled to said high frequency oscillator and said first and second power amplifiers.

14. The electromagnetic discharge apparatus of claim 10 further including a pair of DC input terminals and a DC-to-DC converter having an input coupled to said DC input terminals and having a DC output coupled to said high frequency oscillator and said first and second power amplifiers.

* * * * *